US008872877B2

(12) United States Patent
Igarashi et al.

(10) Patent No.: US 8,872,877 B2
(45) **Date of Patent: *Oct. 28, 2014**

(54) MOTOR CONTROL DEVICE, FLUID EJECTION DEVICE, AND MOTOR CONTROL METHOD

(71) Applicant: Seiko Epson Corporation, Tokyo (JP)

(72) Inventors: Hiroshi Igarashi, Suwa (JP); Kenji Hatada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/827,552

(22) Filed: Mar. 14, 2013

(65) Prior Publication Data

US 2013/0235110 A1 Sep. 12, 2013

Related U.S. Application Data

(63) Continuation of application No. 12/383,975, filed on Mar. 31, 2009, now Pat. No. 8,419,154.

(30) Foreign Application Priority Data

Mar. 31, 2008 (JP) ..... 2008-089966

(51) Int. Cl.
*B41J 15/16* (2006.01)

(52) U.S. Cl.
USPC ..... 347/262; 347/16; 347/264

(58) Field of Classification Search
USPC ..... 347/5, 9, 16, 14, 262, 264
See application file for complete search history.

(56) References Cited

U.S. PATENT DOCUMENTS

| | | | | |
|---|---|---|---|---|
| 6,052,144 | A * | 4/2000 | Reyner | 347/262 |
| 6,991,144 | B2 | 1/2006 | Franz et al. | |
| 2009/0245912 | A1 | 10/2009 | Igarashi et al. | |

FOREIGN PATENT DOCUMENTS

| | | | |
|---|---|---|---|
| JP | 61-027861 | A | 2/1986 |
| JP | 61-178359 | A | 8/1986 |
| JP | 09-030700 | A | 2/1997 |
| JP | 09-124202 | A | 5/1997 |
| JP | 2003 048351 | A | 2/2003 |
| JP | 2003-079177 | A | 3/2003 |
| JP | 2006-008322 | A | 1/2006 |
| JP | 2006-240212 | A | 9/2006 |
| JP | 2007-084317 | A | 4/2007 |
| JP | 2007-290866 | A | 11/2007 |

* cited by examiner

*Primary Examiner* — Lam S Nguyen
(74) *Attorney, Agent, or Firm* — Nutter McClennen & Fish LLP; John J. Penny, Jr.; Derek P. Roller

(57) ABSTRACT

Motor control devices and methods are described herein. In one embodiment, such a device includes a fluid ejection head configured to eject a fluid onto a sheet that is on a downstream side from a transport driving roller along a supply direction of the sheet. The device also includes a first motor that provides a driving force for rotating a roll on which the sheet is wound, and a second motor that provides a driving force for driving the transport driving roller. The transport driving roller is on a downstream side from the roll along the supply direction of the sheet. The device also includes a motor control unit that simultaneously drives the first and second motors, and the motor control unit is configured to control an interpolation output that is given to the first motor while subjected to a change in a driving speed of the second motor.

4 Claims, 9 Drawing Sheets

MOTOR CONTROL DEVICE, FLUID EJECTION DEVICE, AND MOTOR CONTROL METHOD

BACKGROUND

1. Technical Field

The present invention relates to a motor control device, a fluid ejection device, and a motor control method.

2. Related Art

As an ink jet printer, there is a type of printer available for sheets having an A2 or larger size. In many cases, the large-sheet ink jet printer uses a so-called roll paper (hereinafter, the so-called roll paper that is a wound roll is referred to as a roll, and a portion pulled from the roll is referred to as a sheet) in addition to cut papers. Pulling a sheet from a roll is typically performed by a paper feed motor (PF motor). Here, the PF motor is controlled and driven by PID control. As the printer using the roll, a printer is disclosed in JP-A-2007-290866. As the printer which enables the PID control, printers are disclosed in JP-A-20006-240412, JP-A-2003-79177, and JP-A-2003-48351.

The roll in the large-sheet printer is heavy, and a load exerted when a sheet is pulled from the roll is high. Accordingly, when only the PF motor is driven, there is a possibility that the paper is torn up. Therefore, models in which a roll motor for rotating the roll is provided and driven together with the PF motor to pull a sheet have been developed.

Here, as the sheet is pulled from the roll, the diameter and weight of the roll are changed. Accordingly, in the case where a constant output (current) is given to the roll motor, as the diameter and weight of the roller are changed, tension between a transport roller pair rotated by the PF motor and the roll is significantly changed. In addition, for example, in the case where the weight of the roller is reduced and becomes very low, there is a possibility that tension is hardly exerted between the transport roller pair and the roll, and the paper becomes loose. When the change in the tension as described above occurs during printing of the sheet, it may affect the print quality.

SUMMARY

An advantage of some aspects of the invention is that it provides a motor control device that can prevent a change in tension irrespective of the use of a roll when a roll paper is transported to a downstream side by driving a first motor and a second motor, a fluid ejection device, and a motor control method.

According to an aspect of the invention, a motor control device includes: a first motor that provides a driving force for rotating a roll on which a roll paper is wound to supply the roll paper from the roll; a second motor that provides a driving force for driving a transport driving roller which is provided on a downstream side than the roll along a supply direction of the roll paper and used for transporting the roll paper; a load measuring unit that measures a relationship between a load on the first motor and a driving speed of the first motor when the second motor is not driven and the first motor is driven; and a motor control unit that simultaneously drives the first and second motors at a certain timing, provides to the first motor an interpolation output based on the measurement result of the load measurement unit and a driving speed of the second motor during the control, and transports the roll paper to the downstream side by driving the second motor.

With such a configuration, when the second motor is not driven and only the first motor is driven, the relationship between the load on the first motor and the driving speed of the first motor is measured by the load measuring unit. In addition, the motor control unit provides the interpolation output based on the measurement result of the load measuring unit and the driving speed of the second motor to the first motor. Accordingly, the roll paper is not torn up and can be properly transported to the downstream side. In addition, the interpolation output is obtained from the relationship between the load on the first motor and the driving speed of the first motor. Therefore, the interpolation output is provided to the first motor while subjected to the change in the driving speed of the first motor, and the state where the change in the tension exerted on the roll paper is small can be implemented.

In the motor control device according to this aspect of the invention, when the motor control unit simultaneously drives the first and second motors, the motor control unit may control the interpolation output provided to the first motor to give a predetermined tension to the roll paper.

With such a configuration, the first and second motors are simultaneously driven. Therefore, even when a change in the speed occurs, the predetermined tension is stably given to the roll paper. Accordingly, the roll paper does not become loose. In addition, since the predetermined tension is stably exerted on the roll paper, quality of a predetermined process such as printing performed on the downstream upon transporting can be enhanced.

In the motor control device according to this aspect of the invention, the motor control unit may control drives of the first and second motors in the state where a feeding distance of the roll paper fed by driving the second motor is longer than a feeding distance of the roll paper fed by driving the first motor.

With such a configuration, the tension caused by a difference between the feeding distances of the first and second motors is exerted on the roll paper. Accordingly, the roll paper does not become loose. In addition, since the predetermined tension is stably exerted on the roll paper, quality of a predetermined process such as printing performed on the downstream upon transporting can be enhanced.

According to another aspect of the invention, a fluid ejection device includes: the motor control device according to the above-mentioned aspect; and a fluid ejection head that ejects a fluid to the roll paper.

With such a configuration, in the fluid ejection device of a type in which a roll paper is pulled from a roll, the motor control unit provides to the first motor the interpolation output based on the measurement result of the load measuring unit and the driving speed of the second motor. Accordingly, the roll paper is not torn up and can be properly transported to the downstream side. In addition, the interpolation output is obtained from the relationship between the load on the first motor and the driving speed of the first motor. Therefore, the interpolation output is given to the first motor while subjected to the change in the driving speed of the first motor, and the state where the change in the tension exerted on the roll paper is small can be implemented.

According to still another aspect of the invention, a motor control method includes: a load measuring step of measuring a relationship between a load on the first motor and a driving speed of the first motor in the state where a first motor that provides a driving force for rotating a roll on which a roll paper is wound to supply the roll paper from the roll is driven, and a second motor that provides a driving force for driving a transport driving roller that is provided on a downstream side than the roll along a supply direction of the roll paper and used for transporting the roll paper is not driven; and a motor controlling step of simultaneously driving the first and second motors at a certain timing, providing to the first motor an interpolation output based on the measurement result of the load measuring step and a driving speed of the second motor during the control, and transporting the roll paper to the downstream side by driving the second motor.

With such a configuration, when the second motor is not driven and only the first motor is driven, the relationship between the load on the first motor and the driving speed of the first motor is measured in the load measuring step. In addition, in the motor controlling step, the interpolation output based on the measurement result of the load measuring unit and the driving speed of the second motor is given to the first motor. Accordingly, the roll paper is not torn up and can be properly transported to the downstream side. In addition, the interpolation output is obtained from the relationship between the load on the first motor and the driving speed of the first motor. Therefore, the interpolation output is given to the first motor while subjected to the change in the driving speed of the second motor, and the state where the change in the tension exerted on the roll paper is small can be implemented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printer 10 as a fluid ejection device having a motor control device (mainly a controller 100), and a drive control method according to an embodiment of the invention will be described with reference to FIGS. 1 to 11. In addition, the printer 10 in this embodiment is a printer for printing a large sheet, for example, having an A2 or larger size in JIS standard. In addition, the printer in this embodiment is an ink jet printer, and the ink jet printer may be any apparatus employing an ejection method in which an ink is ejected for printing.

In the following description, a lower side indicates a side on which the printer 10 is provided, and an upper side indicates a side spaced from the provided side. In addition, a side for feeding a sheet P is referred to as a feed side (rear end side), and a side for ejecting the sheet P is referred to as a sheet-ejection side (front side).

Schematic Configuration of Printer 10

Figure 1:
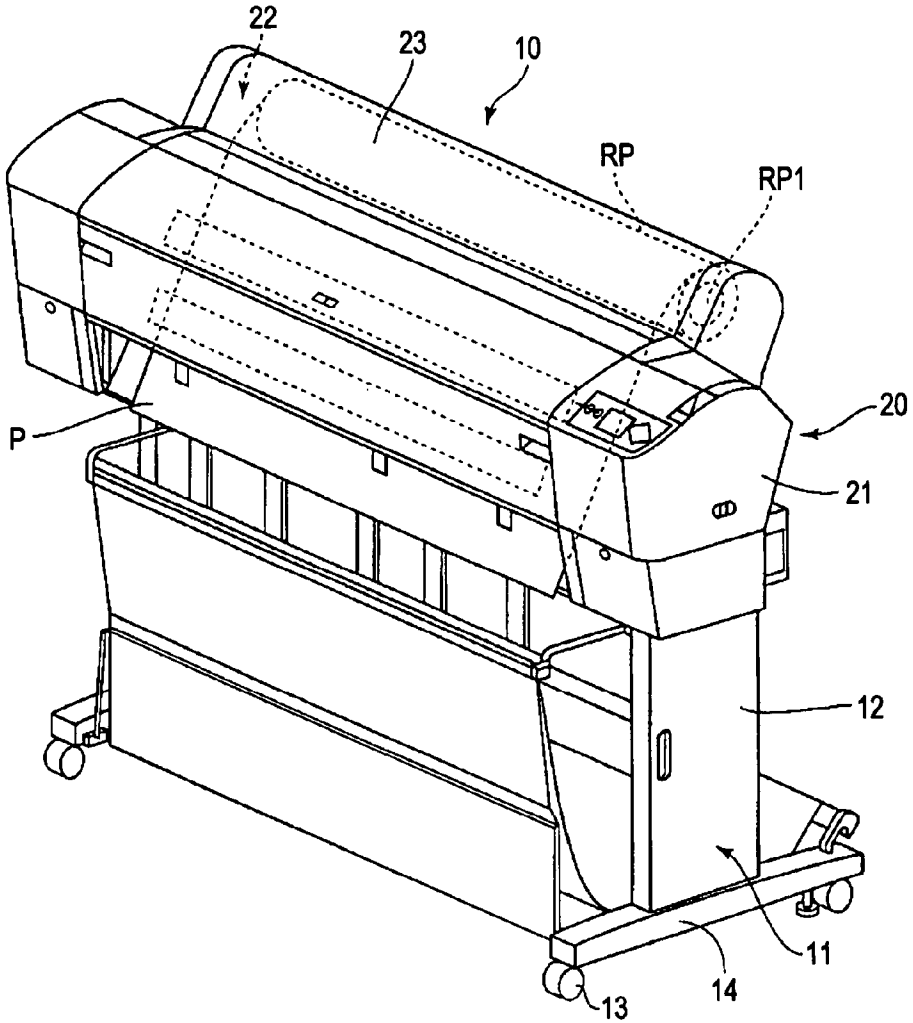
FIG. 1 is a perspective view illustrating a configuration of a printer according to an embodiment of the invention.

As illustrated in FIG. 1, the printer 10 has a pair of legs 11, and a main body 20 supported by the legs 11. The legs 11 are provided with columns 12 and casters 13 rotatably mounted to a caster support 14. Accordingly, a user can move the printer 10 freely.

Figure 2:
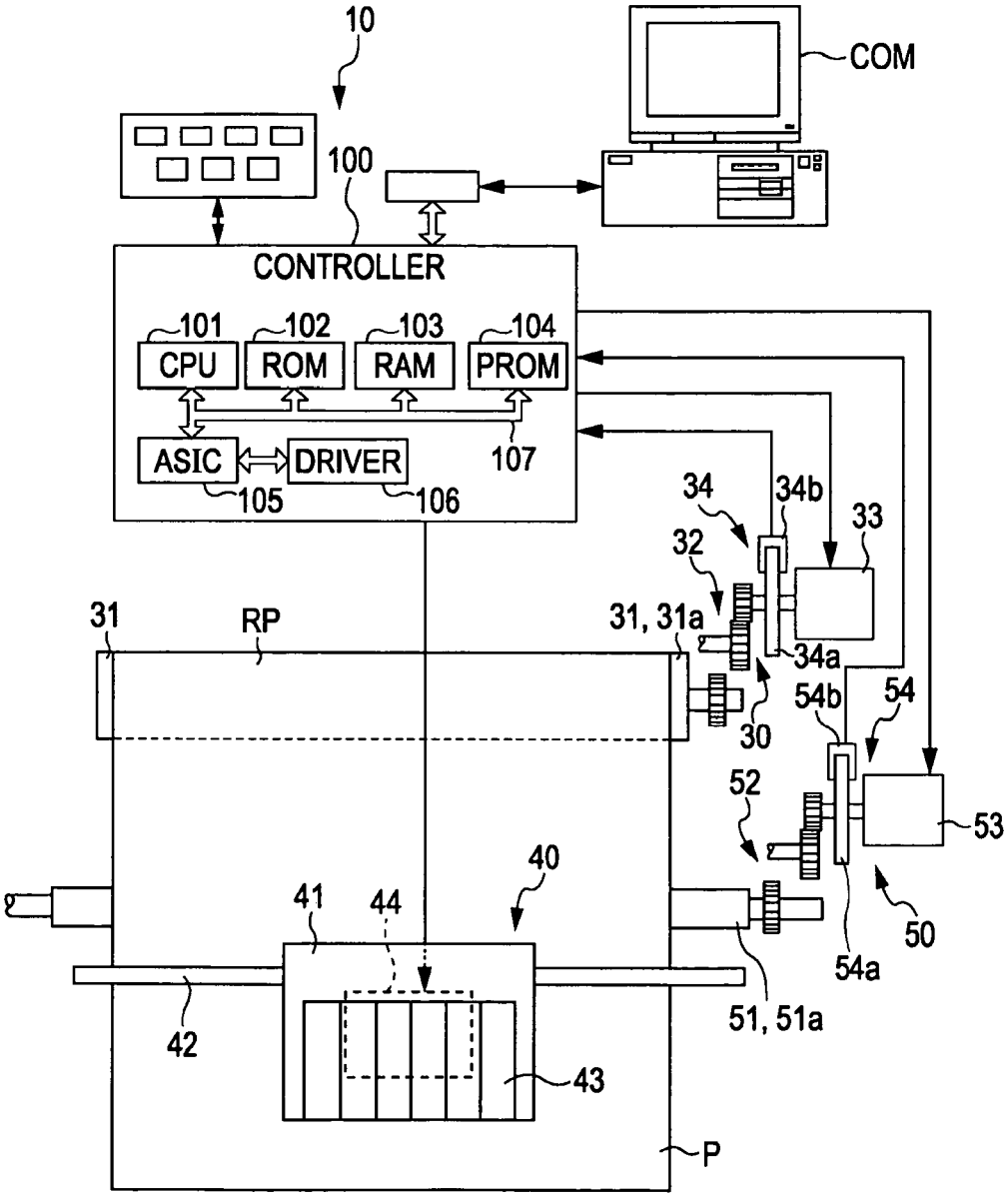
FIG. 2 is a view illustrating a schematic configuration of the printer of FIG. 1.

The main body 20 is supported by a chassis not shown, and various units are mounted in the main body 20 and covered by an external casing 21. In addition, as illustrated in FIG. 2, the main body 20 is provided with, as a drive system using a DC motor, a roll driving mechanism 30, a carriage driving mechanism 40, and a sheet transporting mechanism 50. Particularly, the roll driving mechanism 30 is provided in a roll mounting unit 22 in the main body 20. The roll mounting unit 22 is, as illustrated in FIG. 1, provided on a rear upper side of the main body 20. By opening a cover 23 as a component of the external casing 21, a roll RP is mounted in the roll mounting unit 22, and the roll RP is driven to rotate by the roll driving mechanism 30.

Figure 3:
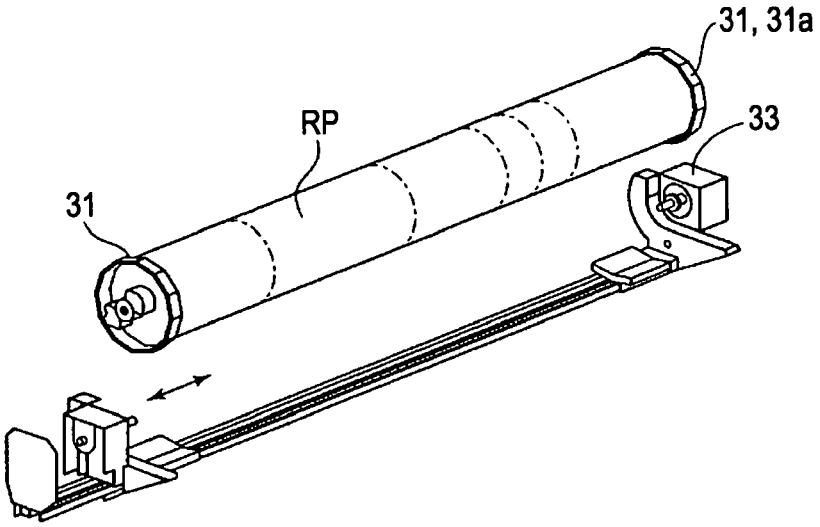
FIG. 3 is a perspective view illustrating a configuration of a rotation holder for storing/maintaining a roll.

In addition, the roll driving mechanism 30 for rotating the roll RP includes, as illustrated in FIGS. 2 and 3, a rotation holder 31, a gear train 32, a roll motor 33, and a rotation detector 34. Among them, the rotation holder 31 is inserted from one of both sides of a hollow portion RP1 of the roll RP, and a pair of the rotation holders 31 is provided to support the both sides of the roll RP. The roll motor 33 corresponds to a first motor. The roll motor 33 provides a driving force (rotational force) to a rotation holder 31*a* as one side of the pair of the rotation holders 31 through the gear train 32. The rotation detector 34 uses a rotary encoder in this embodiment. Accordingly, the rotation detector 34 includes a disc scale 34*a* and a rotary sensor 34*b*. The disc scale 34*a* has light-transmitting portions for transmitting light and light-blocking portions for blocking light transmission, which are formed at predetermined intervals along a-circumferential direction. The rotary sensor 34*b* includes a light-emitting diode not shown, a light-receiving element also not shown, and a signal processing circuit also not shown, as main components.

Figure 4A:
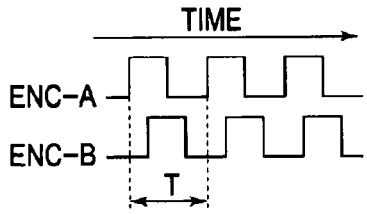
FIG. 4A is a view illustrating ENC signals for normal rotation.
Figure 4B:
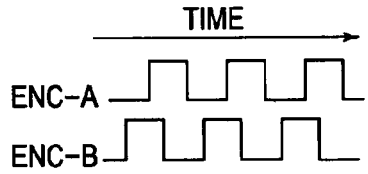
FIG. 4B is a view illustrating ENC signals for reverse rotation.

In this embodiment, as an output from the rotary sensor 34*b*, as illustrated in FIGS. 4A and 4B, pulse signals (an A-phase ENC signal, and a B-phase ENC signal) having a phase difference of 90 degrees are input to a controller 100. Therefore, the normal rotation and the reverse rotation of the roll motor 33 can be detected by propagation/delay of the phases.

The main body 20 is provided with the carriage driving mechanism 40. The carriage driving mechanism 40 includes a carriage 41 that is one of components of an ink supply/ejection mechanism, a carriage shaft 42, and a carriage motor, a belt, and the like not shown.

Particularly, the carriage 41 includes an ink tank 43 for storing color inks (corresponding to the fluid), and the ink tank 43 is supplied with an ink from an ink cartridge (not shown) fixed to the front of the main body 20 through a tube not shown. In addition, as illustrated in FIG. 2, on a lower side of the carriage 41, a print head 44 (corresponding to a fluid ejection head) for ejecting ink droplets is provided. The print head 44 is provided with a nozzle line corresponding to each ink which is not shown, and a piezoelectric element not shown is provided to a nozzle of the nozzle line. By operating the piezoelectric element, ink droplets are ejected from the nozzle at the end portion of an ink passage.

In addition, the carriage 41, the ink tank 43, the tube not shown, the ink cartridge, and the print head 44 constitute the ink supply/ejection mechanism. The driving method of the print head 44 is not limited to the piezoelectric driving method using the piezoelectric element, and may employ, for example, a heater method using force of bubbles produced by heating an ink, a magnetostriction method using a magnetostrictor, a mist-control method of controlling mist in an electric field, and the like. In addition, the ink filled in the ink cartridge/ink tank 43 may be any type of ink including a dye-based ink and a pigment-based ink.

Figure 5:
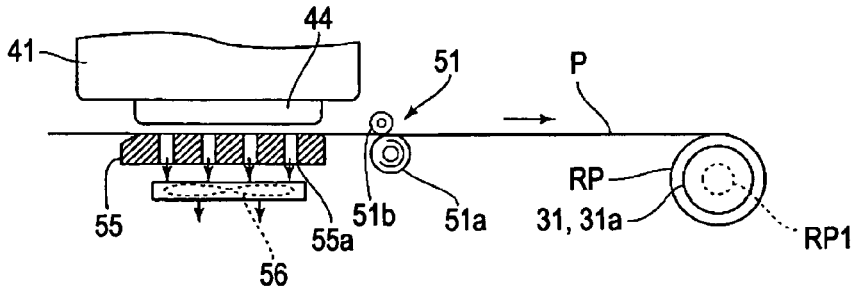
FIG. 5 is a view illustrating a position relationship between a roll, a transport roller pair, and a print head.

As illustrated in FIGS. 2 and 5, the sheet transporting mechanism 50 has a transport roller pair 51, a gear train 52, a PF motor 53, and a rotation detector 54. The transport roller pair 51 includes a transport driving roller 51*a* and a transport driven roller 51*b*, and a sheet P (corresponding to the roll paper) pulled from the roll RP is pinched therebetween. The PF motor 53 provides a driving force (rotational force) to the transport driving roller 51*a* through the gear train 52. Moreover, the rotation detector 54 uses a rotary encoder in this embodiment, similarly to the rotation detector 34 described above, employs a disc scale 54*a* and a rotary sensor 54*b*, and can output pulse signals illustrated in FIGS. 4A and 4B.

On the downstream side (sheet-ejection side) than the transport roller pair 51, a platen 55 is provided, and a sheet P is guided on the platen 55. In addition, the print head 44 faces the platen 55. The platen 55 is provided with vacuum vents 55*a*. The vacuum vents 55*a* are connected to a vacuum fan 56, and as the vacuum fan 56 operates, air is sucked from the print head 44 through the vacuum vents 55*a*. Accordingly, when the sheet P exists on the platen 55, the sheet P can be retained. The printer 10 further includes a paper width detection sensor for detecting the width of the sheet P and other various types of sensors.

Controller

Figure 6:
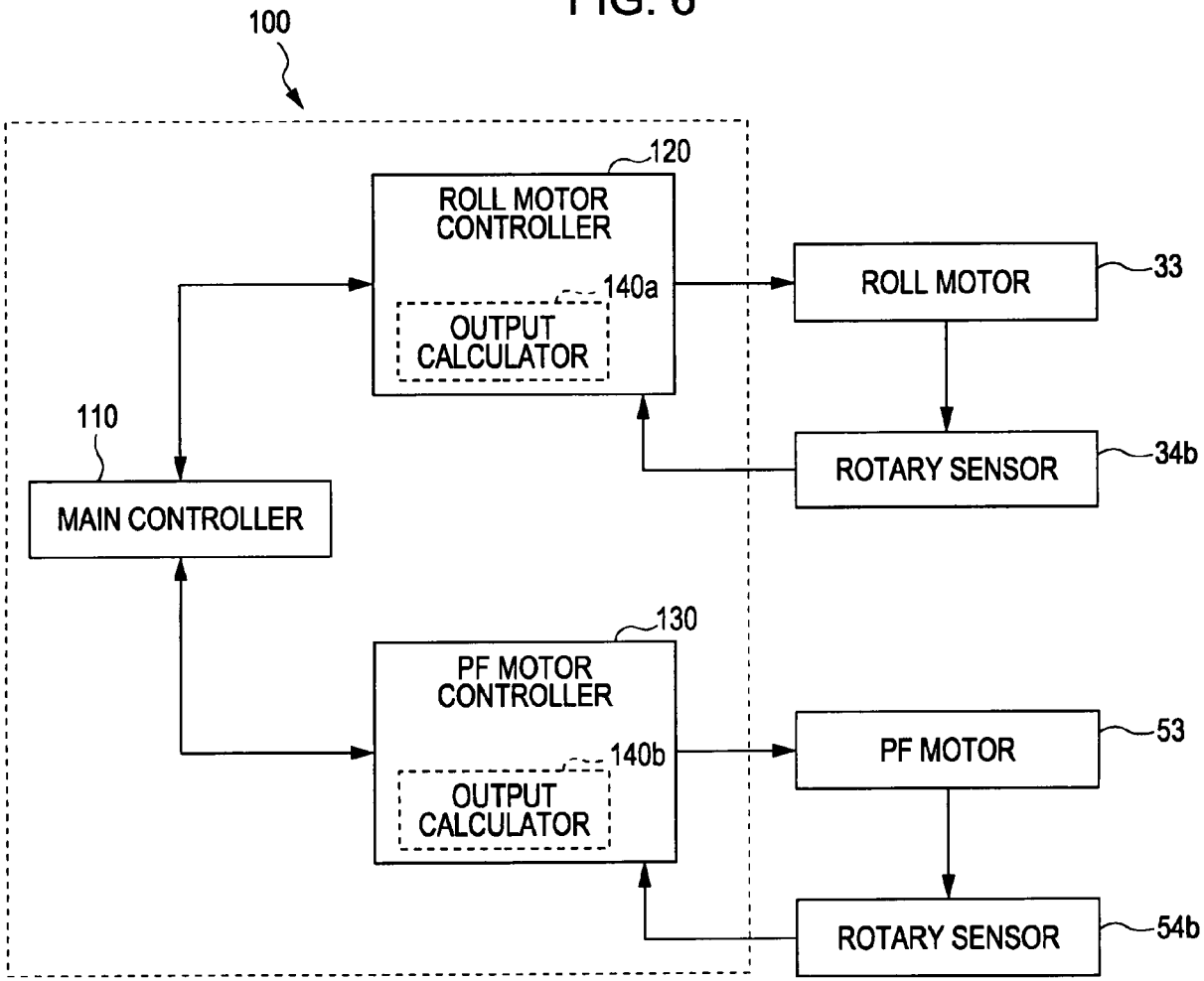
FIG. 6 is a block diagram illustrating an example of a configuration of a controller.

Next, the controller 100 is described with reference to FIGS. 6 and 7. The controller 100 is a unit for control. Specifically, the controller 100 is a unit for enabling control of the roll motor 33 and the PF motor 53 described later, and a unit functioning as a motor control device, a load control unit, and a motor control unit. In addition, the controller 100 receives output signals of the rotary sensors 34*b* and 54*b* described above, a linear sensor not shown, the paper width detection sensor not shown, a gap detection sensor not shown, a power switch for turning the power of the printer 10 on/off, and the like.

As illustrated in FIG. 2, the controller 100 includes a CPU 101, a ROM 102, a RAM 103, a PROM 104, an ASIC 105, a motor driver 106, and the like, and these are connected with each other via a transmission path 107 such as a bus. In addition, the controller 100 is connected to a computer COM. By adding the hardware described above, software stored in the ROM 102 or the PROM 104, and/or circuits or units for performing data cooperation and dedicated processing, a main controller 110, a roll motor controller 120, and a PF motor controller 130 as illustrated in a block diagram of FIG. 6 are implemented.

Particularly, the main controller 110 gives commands to both of the roll motor controller 120 and the PF motor controller 130 for synchronization between the roll motor 33 and the PF motor 53 described later. In addition, in both of the roll motor controller 120 and the PF motor controller 130, output calculators 140*a* and 140*b* (hereinafter, simply referred to as an output calculator 140 in the case where the two do not need to be distinguished) are provided, respectively. The output calculator 140*a* does not perform a PID calculation and performs output control to calculate an actual motor output value Dx described later. In addition, the output calculator 140*b* performs a PID calculation to perform PID control. First, a block diagram of the output calculator 140*b* for performing the PID calculation is described with reference to FIG. 7.

Figure 7:
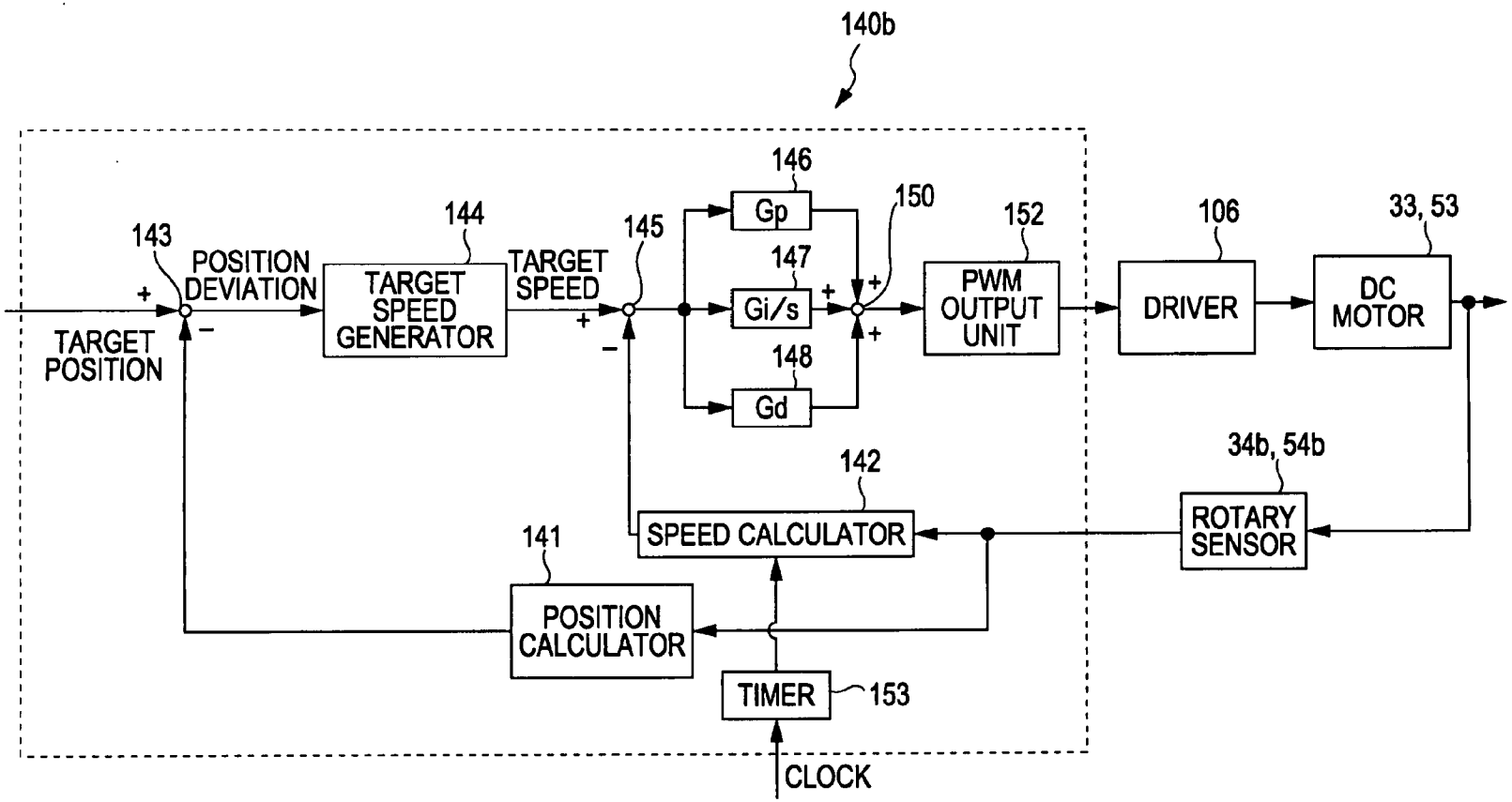
FIG. 7 is a block diagram illustrating a schematic configuration of a PID calculator.

As illustrated in FIG. 7, the output calculator 140*b* includes a position calculator 141, a speed calculator 142, a first subtractor 143, a target speed generator 144, a second subtractor 145, a proportional element 146, an integral element 147, a differential element 148, an adder 150, a PWM signal output unit 152, and a timer 153.

Specifically, the position calculator 141 calculates a feeding distance of the sheet P by counting edges of output signals (see FIGS. 4A and 4B) that are square waves input from the rotary sensors 34*b* and 54*b*. In addition, the speed calculator 142 counts edges of the output signals that are the square waves input from the rotary sensors 34*b* and 54*b*, and receives a signal associated with a time (period) measured by the timer 153. In addition, on the basis of the counted edges and the time (period), a transport speed of the sheet P is calculated.

Figure 8:
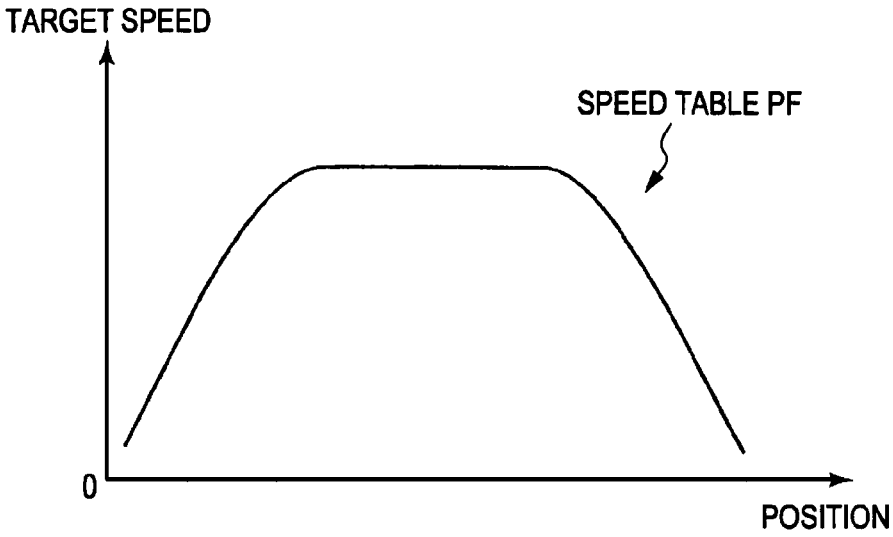
FIG. 8 is a view illustrating an example of a speed table.

In addition, the first subtractor 143 calculates on the basis of information on the feeding distance (current position) output from the position calculator 141 and information on a target position (target stop position) output from a memory such as the ROM 102 and the PROM 104, a position deviation by subtracting the current position from the target position (target stop position). Information on the position deviation output from the first subtractor 143 is input to the target speed generator 144. In addition, the target speed generator 144 outputs information on the target speed according to the corresponding position deviation. The information on the corresponding target speed is related to a speed table as illustrated in FIG. 8. As illustrated in FIG. 8, as the speed table, a speed table Roll related to the roll motor 33 and a speed table PF related to the PF motor 53, that is, two tables exist.

The second subtractor 145 subtracts the transport speed (current speed) of the current motor (the roll motor 33 or the PF motor 53) from the target speed, and calculates and outputs a speed deviation ΔV to the proportional element 146, the integral element 147, and the differential element 148. The proportional element 146, the integral element 147, and the differential element 148 calculate a proportional control value QP, an integral control value QI, and a differential control value QD on the basis of the input speed deviation ΔV, respectively:

$$QP(j)=\Delta V(j)\times Kp \qquad \text{Expression 1}$$

$$QI(j)=QI(j-1)+\Delta V(j)\times Ki;\ \text{and} \qquad \text{Expression 2}$$

$$QD(j)=\{\Delta V(j)-V(j-1)\}\times Kd, \qquad \text{Expression 3}$$

where j is a time, Kp is a proportional gain, Ki is an integral gain, and Kd is a differential gain.

The adder 150 adds the control values output from the proportional element 146, the integral element 147, and the differential element 148 and outputs the sum (sum; Qpid) of the control values to the PWM signal output unit 152.

The control value Qpid output from the adder 150 is input to the PWM signal output unit 152. In addition, the PWM signal output unit 152 outputs a PWM signal of a duty value obtained by converting the received control value Qpid. The timer 153 receives a signal from a clock not shown. In addition, when a predetermined PID calculation period such as 100 μsec passes, the timer 153 outputs a timer signal to the speed calculator 142 every PID calculation period.

In addition, the motor driver 106 controls the roll motor 33 or the PF motor 53 by performing PWM control on the basis of the PWM signal output from the PWM signal output unit 152.

Next, the output calculator 120*a* is described. The output calculator 120*a* performs a calculation for obtaining an actual motor output value Dx (this actual motor output value Dx corresponds to an interpolation output) described as follows. The actual motor output value Dx is obtained by, basically, as shown in Expression 4, subtracting a duty value Duty(f) needed for exerting a predetermined tension F to exert such a tension that the sheet P does not become loose, from a duty value Duty(ro) needed for driving the roll motor 33 at a speed Vn:

$$Dx=\text{Duty}(ro)-\text{Duty}(f)=aVn+b-(F\times r/M)\times\text{Duty}(\max)/Ts, \quad \text{Expression 4}$$

where r is the radius of the roll RP, Duty(max)⁻ is the maximum value of the duty value, Kt is a motor constant of the roll motor 33, E is a power voltage supplied to the roll motor 33, M is a reduction gear ratio of the gear train 32, Ts is a starting torque of the roll motor 33, and coefficients a and b are values defined by Expression 6 and Expression 7 described later. The above-mentioned Expression 4 can be obtained by the following method.

In addition, in the above-mentioned Expression 4, (F×r/M) is a torque by the tension F in consideration of the reduction gear ratio of the gear train. By dividing the torque of (F×r/M) by the starting torque Ts of the roll motor 33, (F×r/M)/Ts that is a nondimensional ratio (a ratio in the case where the duty value Duty(max) is 1) is obtained. In addition, by multiplying the related (F×r/M)/Ts that is the nondimensional ratio by the duty value Duty(max), the duty value Duty(f) needed for exerting the tension F is calculated.

Here, the roll motor 33 is pulled through the sheet P by driving the PF motor 53. Accordingly, the roll motor 33 is driven at the same speed as the speed Vn of the PF motor 53. In addition, the roll motor 33 calculates the speed Vn on the basis of the value detected by the rotary sensor 54*b*.

When the duty value Duty(ro) needed for driving the roll motor 33 at the speed Vn is given to the roll motor 33 so as to drive the roll motor 33 at the same speed Vn as the PF motor 53, the sheet P does not become loose, and tension is not exerted between the roll motor 33 and the PF motor 53. Here, when the duty value Duty(f) needed for giving the tension F is subtracted from the duty value Duty(ro) needed for driving the roll motor 33 at the speed Vn, the sheet P can be provided with such a tension F that the sheet P does not become loose. By using the method described above, the actual motor output value Dx of Expression 4 is obtained.

Calculation of Coefficients a and b of Expression 4

Figure 9:
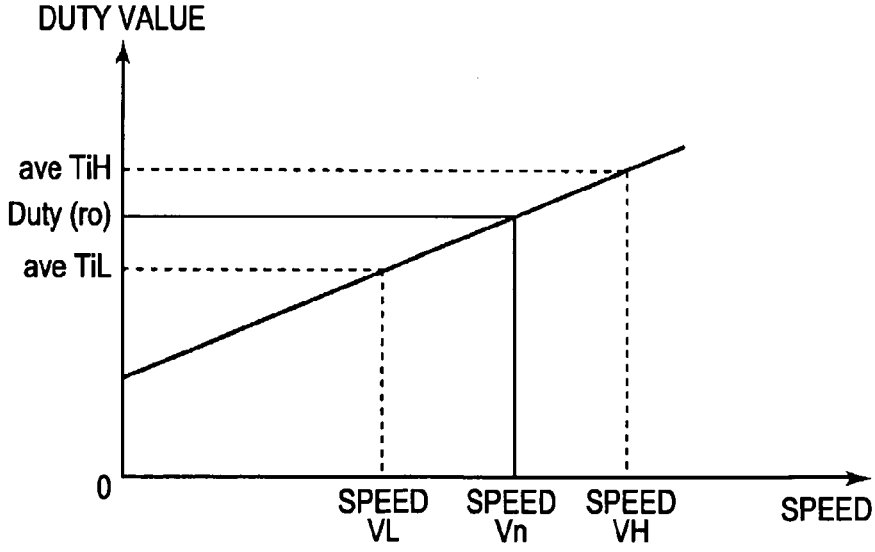
FIG. 9 is a view illustrating a relationship between a duty value and a speed during measurement.

In order to obtain the duty value needed for driving the roll motor 33 at a certain speed Vn, measurement is performed. For measurement, as illustrated in FIG. 9, the roll RP is rotated at a low speed VL and a high speed VH. Thereafter, a measurement value ave TiL needed for driving the roll motor 33 at the low speed VL and a measurement value ave TiH needed for driving the roll motor 33 at the high speed VH are calculated. In addition, the measurement value ave TiL and the measurement value ave TiH are averages of control values output from the integral element 127 when PID control is performed at the respective speeds.

From the relationship of a linear expression illustrated in FIG. 9, the duty value Duty(ro) for driving the roll motor 33 at a speed Vn is easily obtained by using the coefficients a and b.

$$\text{Duty}(ro)=aVn+b \quad \text{Expression 6}$$

$$a=(ave\ TiH-ave\ TiL)/(VH-VL) \quad \text{Expression 7}$$

$$b=ave\ TiH-(ave\ TiH-ave\ TiL)\times VL/(VH-VL) \quad \text{Expression 8}$$

The coefficients a and b are determined on the basis of Expression 7 and Expression 8 described above and used for Expression 4.

Control Method of Roll Motor 33 and PF Motor 53

Figure 10:
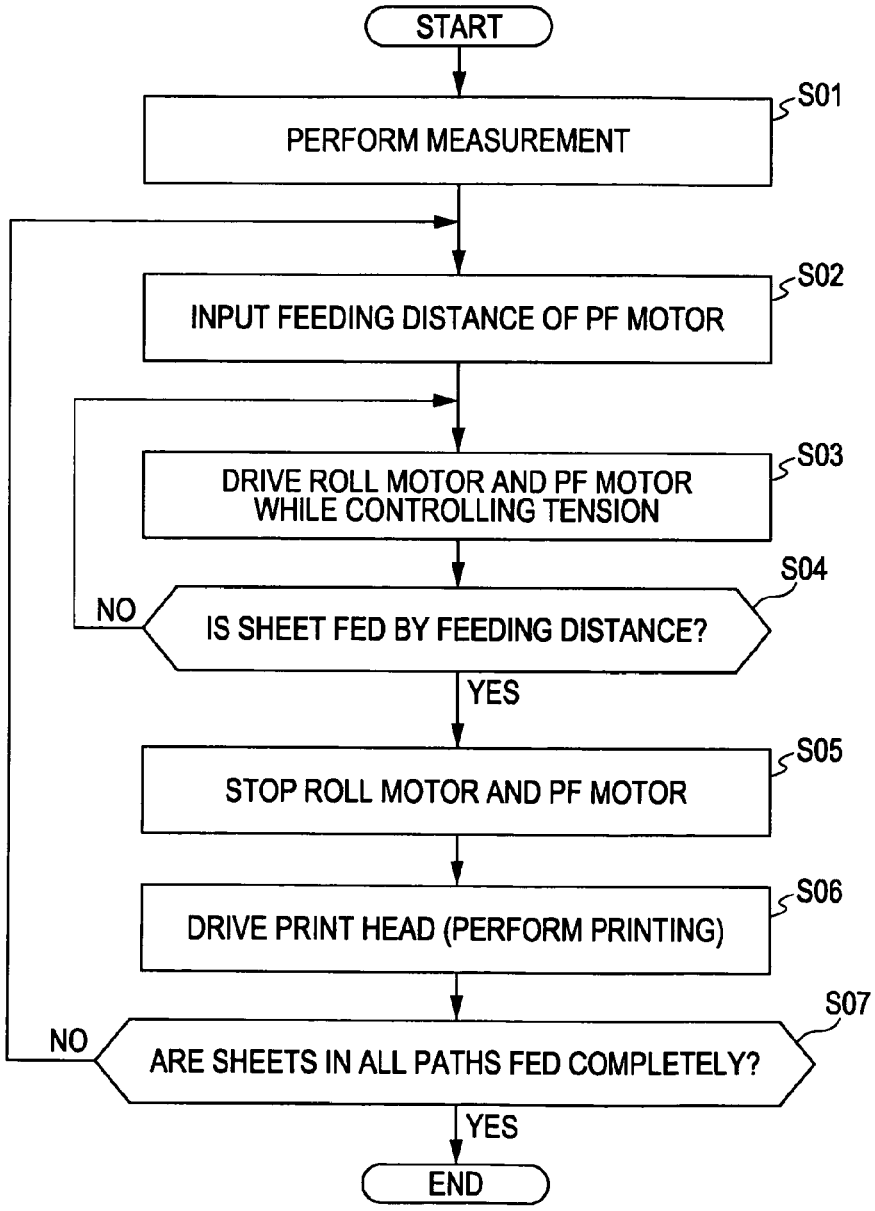
FIG. 10 is a view illustrating operations during synchronization driving control.
Figure 11:
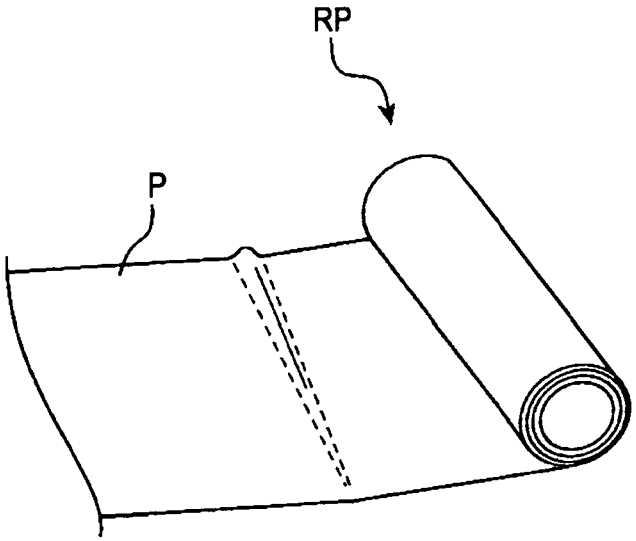
FIG. 11 is a perspective view illustrating the state where a skew occurs in a paper.

In the printer 10 having the above-mentioned configuration, a method of controlling synchronization (skew control) between the roll motor 33 and the PF motor will be described with reference to the flowchart of FIG. 10.

First, before driving the roll motor 33 and the PF motor 53, measurement is performed (S01). During the measurement, according to the commands from the main controller 110, the roll motor 33 is driven at the low and high speeds VL and VH, and the coefficients a and b in Expression 4 as described above are obtained. In addition, the measurement is performed in the state where the PF motor 53 is not driven.

Next, a feeding distance Lpf by driving the PF motor 53 is read from the memory such as the PROM 104 (S02). The feeding distance Lpf is, for example, a value needed for executing printing on the sheet P for only one pass.

When the feeding distance Lpf is read in S02, according to the commands from the main controller 110, the roll motor 33 and the PF motor 53 are started to drive (S03). Here, the PF motor 53 is driven according to the drive table as illustrated in FIG. 8. However, the actual motor output value Dx of the roll motor 33 is determined on the basis of the detection value related to the speed detected by the rotary sensor 34*b*. In addition, when the roll motor 33 and the PF motor 53 are driven, the sheet P can be easily pulled by driving the roll motor 33 as compared with the case where the roll motor 33 does not provide any driving force.

In addition, in S03, the roll motor 33 and the PF motor 53 are controlled to be driven to exert a tension F on the sheet P. During the control of the tension F, the actual motor output value Dx shown in Expression 4 is obtained by the output calculator 140*a* using the above-mentioned calculation. In addition, the actual motor output value Dx is obtained by subtracting the duty value Duty(f) needed for providing a predetermined tension F to give such a tension that the sheet P does not become loose, from the duty value Duty(ro) needed for driving the roll motor 33 at a certain speed Vn. Here, the speed Vn is a driving speed at which the roll motor 33 is pulled through the sheet P by driving the PF motor 53 and eventually rotated. Δs described above, by subtracting the duty value Duty(f) from the duty value Duty(ro), the tension F can be exerted on the sheet P. As driving proceeds while controlling the tension in S03, the sheet P is transported to a portion facing the print head 44 while exerted with the tension F.

The tension F described above can be adjusted. Specifically, depending on a type or size of the sheet P and print characteristics, the tension F can be adjusted as a variable.

When S03 as described above is performed, the main controller 110 determines whether or not the sheet P is transported by the predetermined feeding distance Lpf at every predetermined timing (S04).

In addition, in S04 described above, when it is determined that the sheet is transported by the predetermined feeding distance Lpf (in the case of Yes), the roll motor 33 and the PF motor 53 stop driving (S05).

Next, the print head 44 is driven to scan the sheet P in a width direction thereof by driving a carriage motor not shown (S06). Accordingly, ink droplets are applied to the sheet P, and printing for one pass is executed. When printing for one pass is terminated, it is determined whether or not feeding sheets in all passes are terminated (S07). In addition, when it is determined that feeding sheets in all passes is terminated during the determination (in the case of Yes), the series of the steps are terminated. In S07, when it is determined that feeding the sheets in all passes is not terminated (in the case of No), the step is returned to S02 and the subsequent steps are performed.

In addition, when it is determined that the sheet is not transported by the predetermined feeding distance Lpf during the determination in S04 described above (in the case of No), the step is returned to S03 and the subsequent steps are performed.

Effects in Applications of the Invention

In the printer 10 having the above-mentioned configuration, by performing the measurement operation as illustrated in FIG. 9, the relationship between the load on the roll motor 33 and the driving speed thereof when the PF motor 53 is not driven and only the roll motor 33 is driven is measured. In addition, the controller 100 gives to the roll motor 33 the actual motor output value Dx based on the measurement operation illustrated in FIG. 9 and the driving speed of the PF motor 53. Accordingly, the sheet P is not torn up and can be properly transported to the downstream side. In addition, the actual motor output value Dx is calculated by obtaining the duty value Duty(ro) from the relation as illustrated in FIG. 9 for the load on the roll motor 33 and applying the duty value Duty(ro). Accordingly, even when the driving speed of the PF motor 53 is changed, the actual motor output value Dx is given to the roll motor 33 while subjected to a change in the driving speed. Therefore, the sheet P does not become loose, and the state where the change in the tension F exerted on the sheet P is small can be implemented.

In addition, although an individual variation (nonuniformity) in the roll motor 33, the PF motor 53, and a power source for providing power to the roll motor 33 and the PF motor 53 exists, nonuniformity of the tension F exerted on the sheet P can be suppressed by the above-mentioned tension control. In addition, in this embodiment, the roll motor 33 and the PF motor 53 are simultaneously driven. Therefore, even when a change in the speed occurs, the predetermined tension F can be given to the sheet P. Accordingly, the sheet P does not become loose, and the predetermined tension F is always exerted thereon. As described above, after the tension F is set to a level, printing is executed while the set tension F that is always stable is exerted on the sheet P in the range where the setting is effective. Accordingly, print quality of the sheet P can be enhanced.

In addition, depending on a type or size of the sheet P and print characteristics, the tension F can be adjusted as a variable, and the tension F can be set to a value corresponding to various requirements for printing.

In addition, in this embodiment of the invention, in the state where the feeding distance of the sheet P by driving the PF motor 53 is longer than the feeding distance of the sheet P by driving the roll motor 33, driving of the roll motor 33 and the PF motor 53 can be controlled. In this case, the tension F caused by a difference between the feeding distances of the roll motor 33 and the PF motor 53 is exerted on the sheet P. Accordingly, the sheet P does not become loose. In addition, since the predetermined tension F is stably exerted on the sheet P, print quality of the sheet P on the downstream side during the transport of the sheet P can be enhanced.

Another Embodiment

While the embodiment of the invention has been described, modifications thereof can be made. This will be described as follows. In the above-mentioned embodiment, the case where the motor control device is provided to the printer 10 is described. However, the motor control device is not only provided to the printer 10, but also applied to a fax or the like using a roll (roll paper). In addition, in the above-mentioned embodiment, the sheet P is a roll paper. However, in addition to the sheet P, a member like a film, a sheet made of resin, an aluminum foil, and the like may be employed.

In addition, in the above-mentioned embodiment, when a change in a level of the output signal (ENC signal) is detected, the A-phase and B-phase ENC signals, that is, the two signals are used. However, when the change in the level of the output signal is detected, only a single ENC signal or three or more ENC signals with different phases can be used.

In addition, the controller 100 is not limited by the above-mentioned embodiment. For example, only the ASIC 105 is configured to control the roll motor 33 and the PF motor 53. In addition, a 1-chip microcomputer may be assembled with various peripheral devices to constitute the controller 100.

Moreover, in the above-mentioned embodiment, the PID control performed by the controller 100 is associated with the speed. However, PID control associated with a position can be performed. In addition, control of the PF motor 53 is not limited to the PID control, and PI control can be applied to the embodiment of the invention.

In addition, the printer 10 in the above-mentioned embodiment may be a section of a scanner, a copy machine, or a multi-function apparatus. Moreover, in the above-mentioned embodiment, the ink jet printer 10 is described. However, the printer 10 is not limited to an ink jet printer as long as the printer 10 can eject a fluid. For example, a gel jet printer, a printer using a toner, a dot matrix impact printer, and various types of printer can be applied.

The present application claims the priority based on a Japanese Patent Application No. 2008-089966 filed on Mar. 21, 2008, the disclosure of which is hereby incorporated by reference in its entirety.

What is claimed is:

1. A device comprising:

a fluid ejection head configured to eject a fluid onto a sheet, the fluid ejection head being provided on a downstream side from a transport driving roller along a supply direction of the sheet;

a first motor that provides a driving force for rotating a roll on which the sheet is wound;

a second motor that provides a driving force for driving the transport driving roller, the transport driving roller being provided on a downstream side from the roll along the supply direction of the sheet; and a motor control unit that simultaneously drives the first and second motors, the motor control unit being configured to control an interpolation output that is given to the first motor while subjected to a change in a driving speed of the second motor.

2. The device according to claim 1, wherein the motor control unit is configured to control the interpolation output provided to the first motor to give a predetermined tension to the roll paper.

3. The device according to claim 1, wherein the motor control unit drives the first motor and the second motor in a state where a feeding distance of the roll paper fed by driving the second motor is longer than a feeding distance of the roll paper fed by driving the first motor.

4. The device according to claim 1, wherein the transport driving roller transports the sheet.

* * * * *

UNITED STATES PATENT AND TRADEMARK OFFICE

CERTIFICATE OF CORRECTION

PATENT NO. : 8,872,877 B2
APPLICATION NO. : 13/827552
DATED : October 28, 2014
INVENTOR(S) : Hitoshi Igarashi and Kenji Hatada It is certified that error appears in the above-identified patent and that said Letters Patent is hereby corrected as shown below:

In the item (72) listing Inventors on page 1, Column 1, replace the inventor name "Hiroshi Igarashi" with the name "Hitoshi Igarashi"

Signed and Sealed this
Seventh Day of March, 2017

Michelle K. Lee

Michelle K. Lee
*Director of the United States Patent and Trademark Office*